US007832334B2

(12) United States Patent
Vrotacoe et al.

(10) Patent No.: US 7,832,334 B2
(45) Date of Patent: Nov. 16, 2010

(54) PRINTING BLANKET WITH CONVEX CARRIER LAYER

(75) Inventors: James Brian Vrotacoe, Barrington, NH (US); Richard Karl Weiler, Durham, NH (US); James Richard Belanger, Portsmouth, NH (US)

(73) Assignee: Goss International Americas, Inc., Durham, NH (US)

( * ) Notice: Subject to any disclaimer, the term of this patent is extended or adjusted under 35 U.S.C. 154(b) by 310 days.

(21) Appl. No.: 11/376,013

(22) Filed: Mar. 15, 2006

(65) Prior Publication Data

US 2006/0156935 A1 Jul. 20, 2006

Related U.S. Application Data

(62) Division of application No. 10/617,639, filed on Jul. 11, 2003, now Pat. No. 7,073,435.

(51) Int. Cl.
*B41N 10/04* (2006.01)
*B41F 13/193* (2006.01)

(52) U.S. Cl. ..... 101/217; 101/376; 428/909

(58) Field of Classification Search ..... None
See application file for complete search history.

(56) References Cited

U.S. PATENT DOCUMENTS

| | | | | |
|---|---|---|---|---|
| 3,616,751 | A | 11/1971 | Mowry | 101/220 |
| 5,522,315 | A | 6/1996 | Behnke et al. | 101/376 |
| 5,768,990 | A * | 6/1998 | Vrotacoe et al. | 101/217 |
| 5,863,367 | A | 1/1999 | Behnke et al. | 156/154 |
| 6,062,138 | A | 5/2000 | Fromson et al. | 101/217 |
| 6,082,257 | A | 7/2000 | Secor | 101/137 |
| 6,105,498 | A | 8/2000 | Vrotacoe et al. | 101/376 |
| 6,283,027 | B1 | 9/2001 | Vrotacoe et al. | 101/376 |
| 7,073,435 | B2 * | 7/2006 | Vrotacoe et al. | 101/217 |
| 7,104,198 | B2 * | 9/2006 | Weiler et al. | 101/376 |
| 7,559,278 | B2 * | 7/2009 | Hoffmann et al. | 101/375 |

FOREIGN PATENT DOCUMENTS

| | | |
|---|---|---|
| DE | 2847865 | 5/1980 |
| JP | 2002029174 | 1/2002 |

* cited by examiner

*Primary Examiner*—Leslie J Evanisko
(74) *Attorney, Agent, or Firm*—Davidson, Davidson & Kappel, LLC

(57) ABSTRACT

A printing blanket includes a carrier sleeve layer having at least one axially convex surface and a print layer disposed over the carrier sleeve layer. A blanket cylinder with a convex outer surface and a convex shim is also provided. An offset printing press is also provided.

2 Claims, 7 Drawing Sheets

PRINTING BLANKET WITH CONVEX CARRIER LAYER

CROSS-REFERENCE TO RELATED APPLICATIONS

This is a divisional of U.S. patent application Ser. No. 10/617,639 filed Jul. 11, 2003, and hereby incorporated by reference herein which issued as U.S. Pat. No. 7,073,435 on Jul. 11, 2006.

BACKGROUND INFORMATION

The present invention relates generally to offset printing and more specifically to a printing blanket for an offset printing press.

U.S. Pat. Nos. 6,283,027 and 6,105,498, hereby incorporated by reference herein, disclose varying profile blankets, including printing blankets with concave and convex profiles. A concave blanket cylinder is also disclosed.

U.S. Pat. Nos. 5,522,315 and 5,863,367 disclose a printing blanket with a convex compressible layer to spread the web and prevent inward wrinkling. The carrier layer for the blanket is flat.

BRIEF SUMMARY OF THE INVENTION

An object of the present invention is to compensate for reduced print pressure often found in the center of a blanket cylinder while still avoiding inward wrinkling.

The present invention provides a printing blanket comprising:

a carrier sleeve layer having at least one axially convex surface when disposed on a blanket cylinder; and a print layer disposed over the carrier sleeve layer.

By having an inner convex carrier sleeve layer with a convex surface, the print pressure at the axial center of the blanket cylinder can be increased.

The convexity of the carrier sleeve layer may be provided, for example, by having the carrier sleeve layer have a uniform inner diameter and a convex outer diameter. The carrier sleeve layer itself is thus thicker in an axial middle than at the ends.

Alternately, the carrier sleeve can be of uniform thickness, and the blanket cylinder or a shim may provide the surface convexity.

The print layer may have a uniform thickness or a varying thickness. Most preferably, the outer surface of the print layer has a convex axial profile when the blanket is disposed on the blanket cylinder, although this is not necessary.

The blanket when disposed on the blanket cylinder thus preferably provides uniform axial print or nip pressure across the width of the blanket.

A compressible layer preferably is disposed between the carrier sleeve layer and the print layer. The compressible layer may be of uniform thickness, or of varying thickness.

The blanket preferably is gapless tubular blanket.

An inextensible layer, for example made of wound fibers or textile fabric, may be provided over the compressible layer and underneath the print layer.

Also provided by the present invention is an offset print unit comprising an image cylinder, a blanket cylinder having an axially convex outer surface, and a printing blanket disposed over the axially convex outer surface.

Further provided as well is an axially profiled shim for placement between a blanket cylinder and a blanket, the shim having an axially convex outer surface. Preferably, the inner surface has a uniform diameter. The shim is preferably tubular and gapless.

The blanket cylinder and blanket are most advantageous for narrow blanket cylinders with a wide axial extent, as these are most prone to bending. Thus, the blanket advantageously carries at least two images axially, and may carry at least three images in the axial direction while only one image is carried in the circumferential direction. Four axial images may be most advantageous.

BRIEF DESCRIPTION OF THE DRAWINGS

The present invention will be further described with respect the following Figures, in which.

DETAILED DESCRIPTION

Figure 1A:
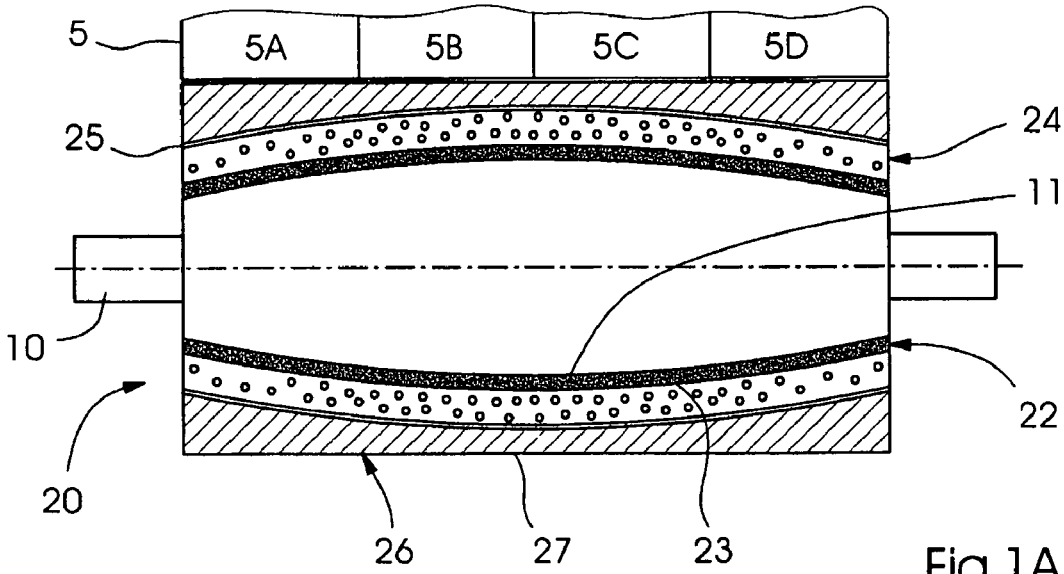
FIGS. 1*a* and 1*b* show schematically embodiments of the convex blanket cylinder with a blanket having a uniform carrier sleeve layer with a convex surface.

FIG. 1A shows schematically a blanket cylinder 10 having a convex outer surface 11. Blanket cylinder 10 may be made of metal, for example milled steel. The curvature of the outer surface 11 is exaggerated in the figures for clarity. A blanket 20 fits over blanket cylinder 10, for example by sliding axially if the blanket is gapless and tubular, and blanket cylinder 10 may be provided with air holes for providing pressurized air for this purpose.

Blanket 20 includes a carrier sleeve layer 22, which may be made for example of a fiberglass sleeve available commercially from Rotec GmbH & Co. KG of Ahaus-Ottenstein, Germany. Carrier sleeve layer 22 preferably is solid and rigid enough to maintain a tubular shape to permit axial placement of the blanket 20 on blanket cylinder 10, yet flexible enough to permit the expansion necessary fit the blanket 20 over the cylinder 10.

Carrier sleeve layer 22 thus has a convex outer surface 23 when located on blanket cylinder 10. A compressible layer 24 which also may be wider in an axial middle section than at the axial ends of blanket 20 is located over the outer surface 23. Compressible layer 24 may be, for example, rubber with air bubbles therein or microspheres located therein to provide compressibility.

An inextensible layer 25, for example a thread or fabric layer, may be located over compressible layer 24. Inextensible layer 25 may aid in maintaining the shape of the compressible layer 24.

A print layer 26 forms the outer layer, and may be made, for example, of solid rubber. In the embodiment of FIG. 1A, the print layer 26 is formed so that the outer print surface 27 is perfectly cylindrical when the blanket 20 is on blanket cylinder 10 and no pressure is applied to blanket 20.

Print surface 27 is inked by an image cylinder 5, for example a plate cylinder. Image cylinder 5 may have for example four image areas 5A, 5B, 5C, 5D axially, each image area covering the circumference of image cylinder 5, a so-called one around configuration. However, image cylinder 5 could also have two (or more) images spaced circumferentially, a so-called two (or more) around configuration.

Preferably, the number of axial images is at least twice the number of circumferential images, and may be three, four or more times the number of circumferential images, as the present invention is most advantageous with small diameter, large width blankets.

Figure 1B:
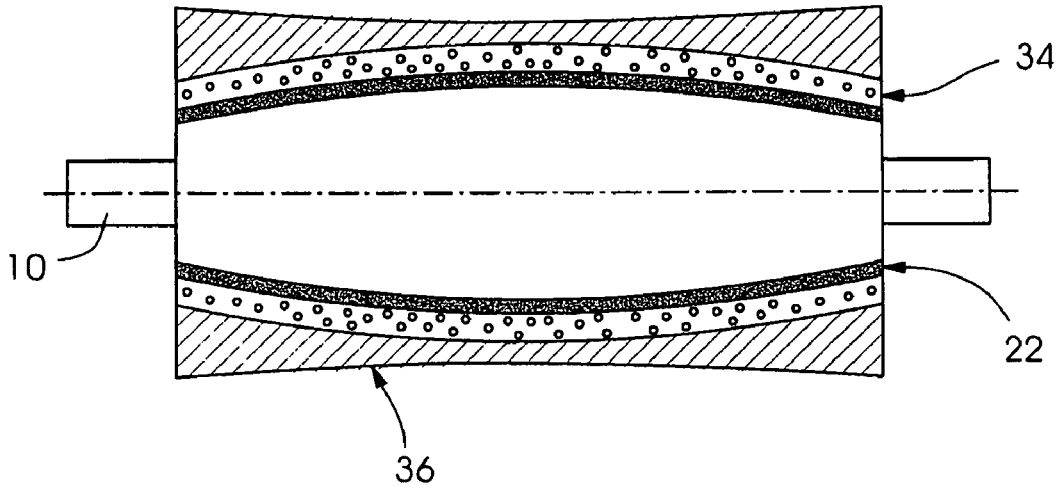

FIG. 1B shows an alternate blanket in which compressible layer 34 has a uniform thickness, and print layer 36 has a concave outer print surface.

Figure 2A:
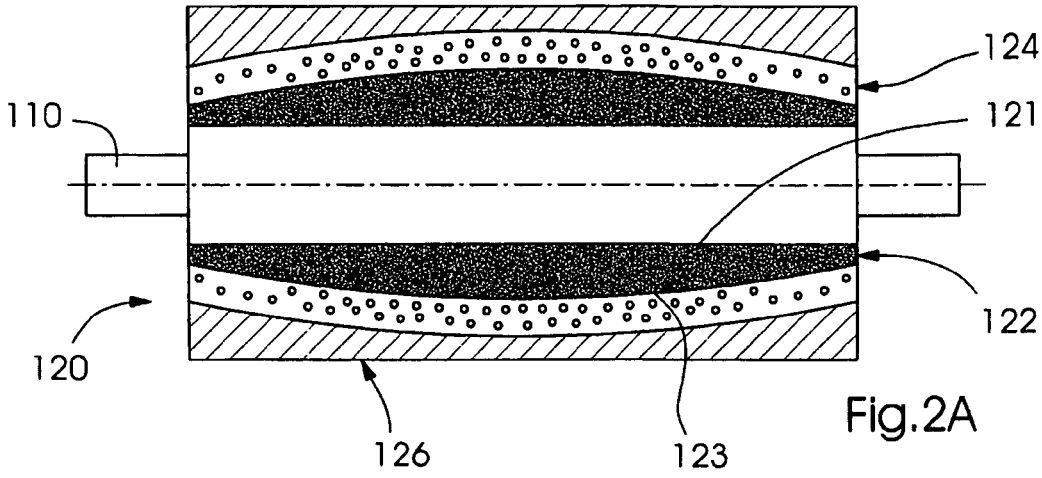
FIGS. 2*a*, 2*b*, 2*c*, 2*d*, 2*e*, 2*f* and 2*g* show schematically embodiments of a blanket with a convex carrier sleeve layer.

FIG. 2A shows an alternate embodiment of a blanket 120 on a straight outer surface cylindrical blanket cylinder 110. Blanket 120 has a carrier sleeve layer 122 with an outer convex surface 123 and a straight inner surface 121 when no pressure is applied to blanket 120. Compressible layer 124 is thicker in the middle of blanket 120 than at the axial ends. Print layer 126 is formed so that the outer print surface is perfectly cylindrical when the blanket 120 is on blanket cylinder 110 and no pressure is applied to blanket 120.

Figure 2B:
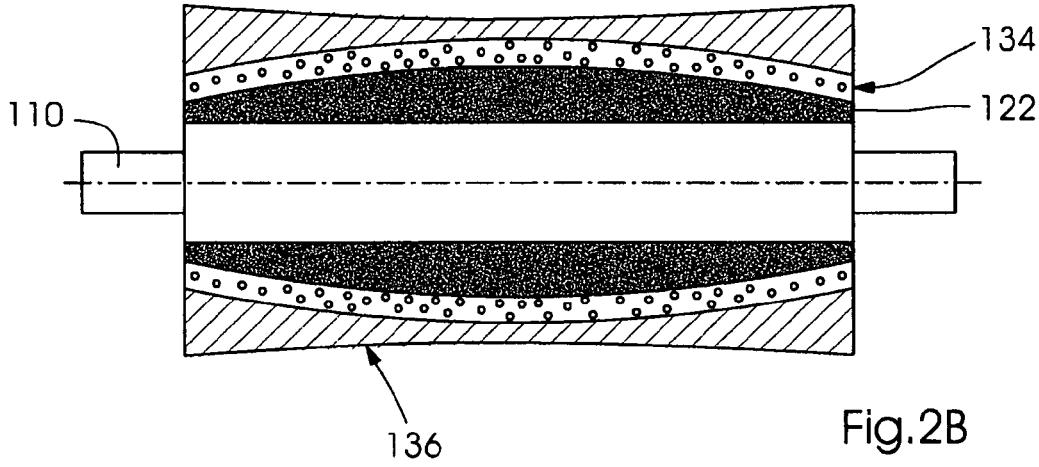

FIG. 2B shows an alternate embodiment with a similar carrier sleeve layer 122 to FIG. 2A in which compressible layer 134 has a uniform thickness and print layer 136 a concave outer print surface when no pressure is applied to the blanket.

Figure 2C:
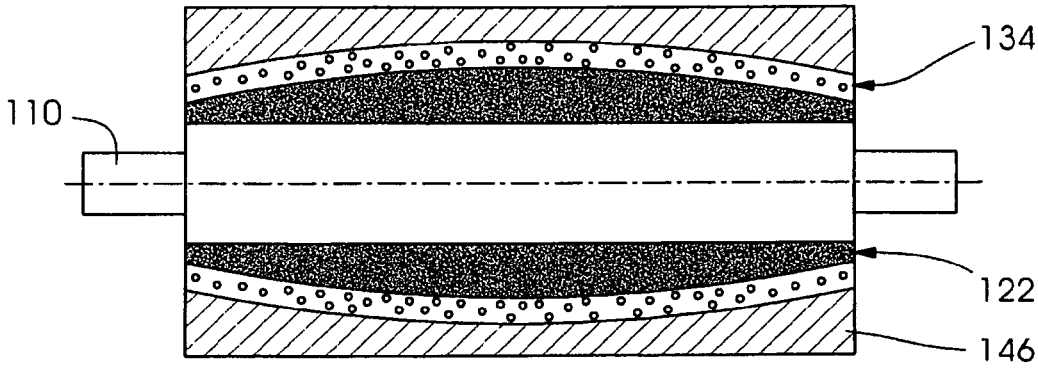

FIG. 2C shows an alternate embodiment in which compressible layer 134 has a uniform thickness and print layer 146 a straight outer print surface when no pressure is applied to the blanket.

Figure 2D:
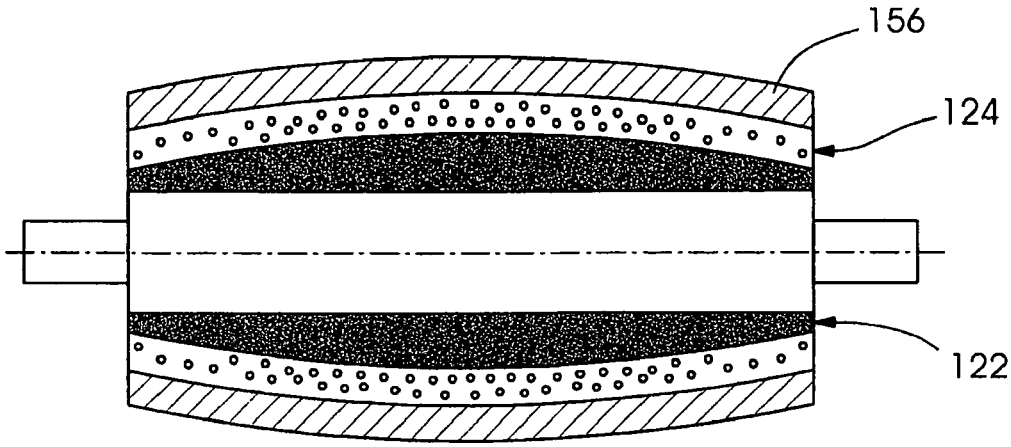

FIG. 2D shows an alternate embodiment in which compressible layer 124 has a larger thickness in the axial middle and print layer 156 has a uniform thickness so that a convex outer print surface results when no pressure is applied to the blanket.

Figure 2E:
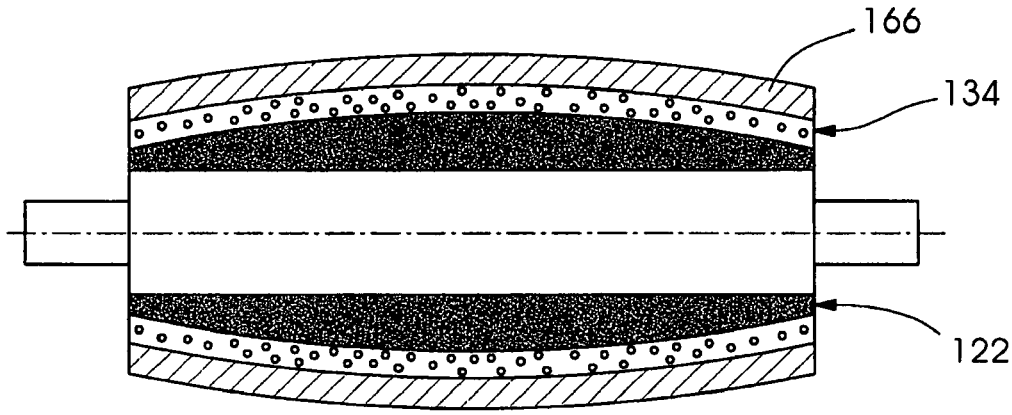

FIG. 2E shows an alternate embodiment in which compressible layer 134 has a uniform thickness and print layer 166 has a uniform thickness so that a convex outer print surface results when no pressure is applied to the blanket.

Figure 2F:
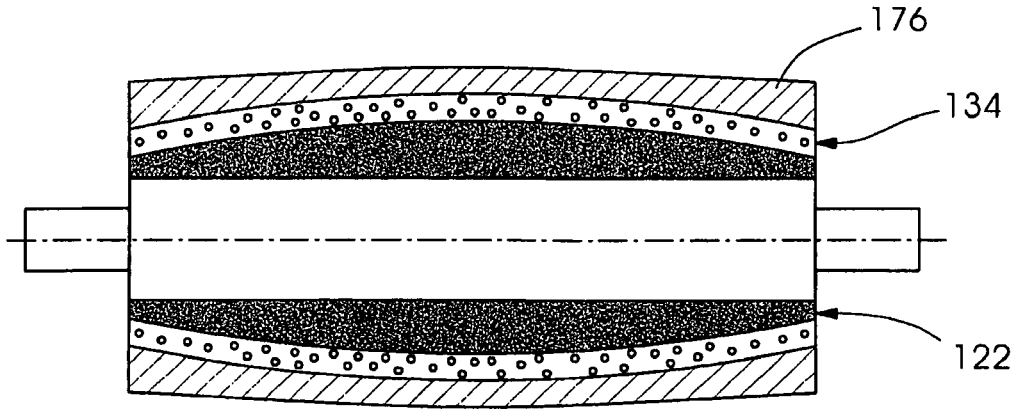

FIG. 2F shows an alternate embodiment in which compressible layer 134 has a uniform thickness and print layer 176 has thicker axial ends, but with a convex outer print surface still resulting when no pressure is applied to the blanket.

Figure 2G:
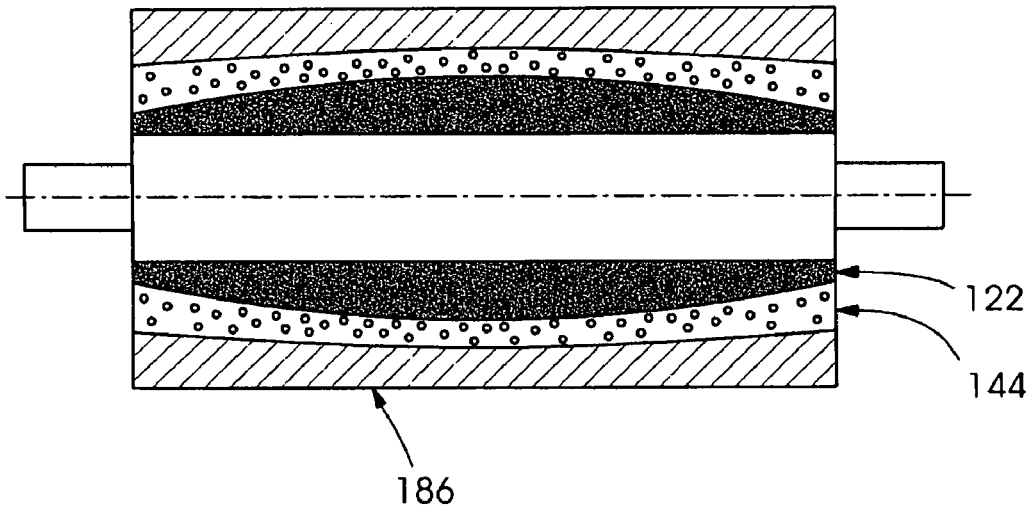

FIG. 2G shows an alternate embodiment in which compressible layer 144 has thicker axial ends, as does print layer 186, so that a straight outer print surface results when no pressure is applied to the blanket.

Figure 3A:
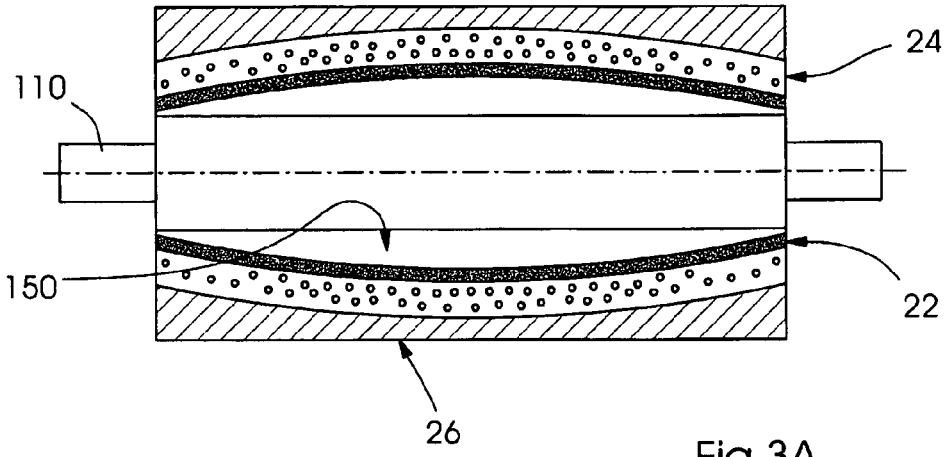
FIGS. 3*a* and 3*b* show schematically embodiments of the blanket cylinder, shim and blanket combination of the present invention.

FIG. 3A shows a similar embodiment to the FIG. 1A embodiment, except the blanket cylinder 110 may have a straight outer surface. A shim 150, made for example of MYLAR sheets, is provided, it may be adhered to the cylinder 110 or be an insertable and reusable tube which fits inside the carrier sleeve.

Figure 3B:
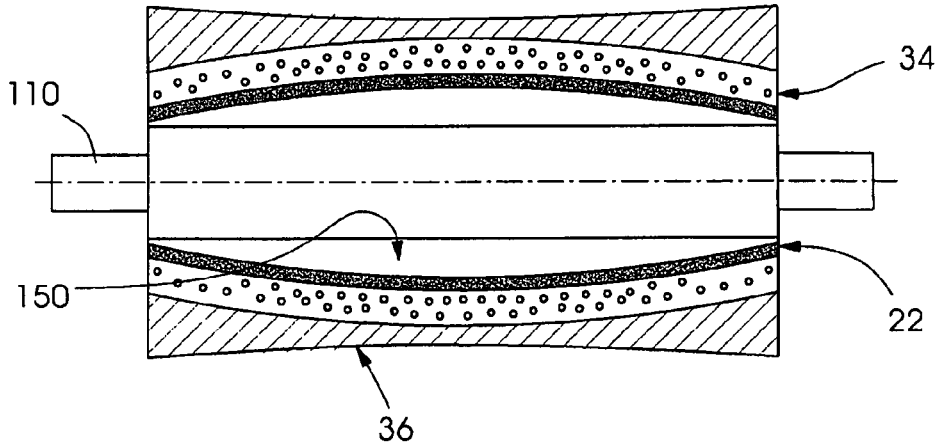

FIG. 3B shows a similar embodiment to the FIG. 1B, except the blanket cylinder 110 may have a straight outer surface. A shim 150 similar to that of FIG. 3A may be used to provide convexity.

Figure 4A:
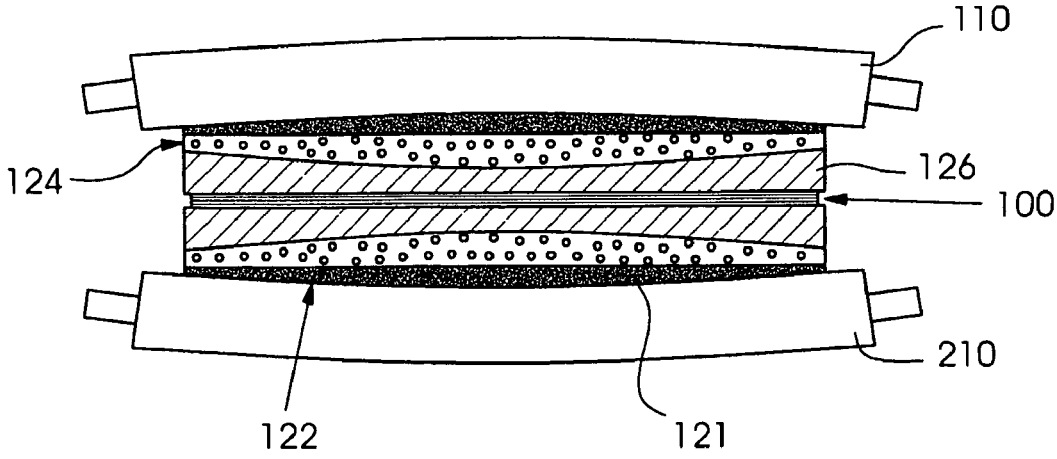
FIGS. 4*a* and *b* show schematically a blanket-to-blanket nip for the embodiments of FIGS. 2*a* and 2*e* respectively.

FIG. 4A shows in a simplified schematic the bending of blanket cylinders 110 and 210, each blanket cylinder 110, 210 having a blanket similar to the FIG. 2A embodiment. As can be seen, the inner surface 121 becomes convex and the convexity of the inner surface 121 and the layer 122 can help compensate for reduced print pressure at the axial middle on the paper or other printing substrate 100.

Figure 4B:
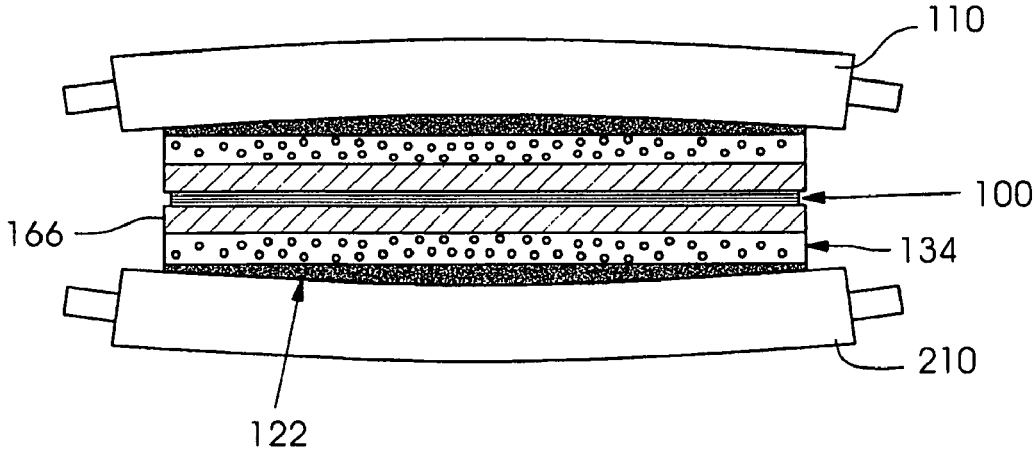

FIG. 4B shows a simplified schematic of blanket cylinders 110, 210 with blankets similar to the FIG. 2E embodiment.

Figure 5A:
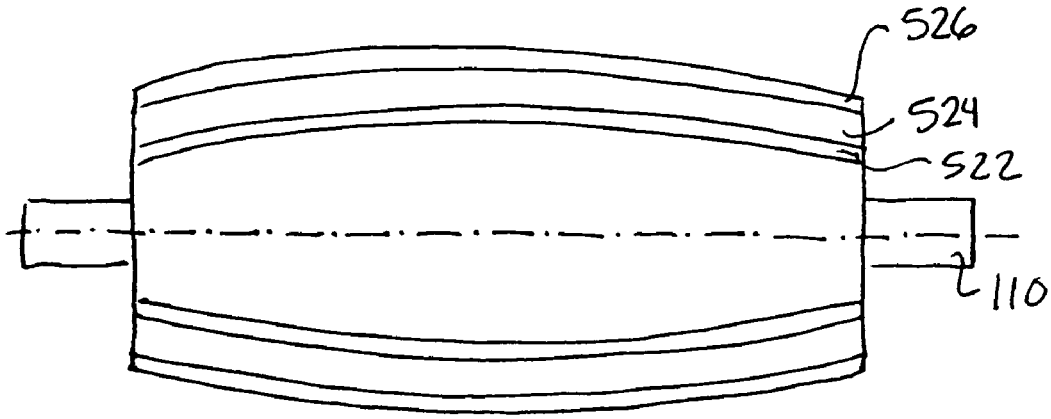
FIG. 5A shows schematically an embodiment of the convex blanket cylinder with a blanket having a uniform carrier sleeve layer and a uniform print layer with a convex surface.

FIG. 5A shows convex blanket cylinder 110 having a carrier sleeve layer 522 with a uniform thickness. Carrier sleeve layer 522 has a convex profile when mounted on blanket cylinder 110. A compressible layer 524 may be placed over carrier sleeve layer 522. Compressible layer 524 may also be uniform. A print layer 526 forms the outer layer, and may be made, for example, of solid rubber. In the embodiment of FIG. 5A, the print layer 526 is uniform so the outer surface is convex when the blanket is on blanket cylinder 110 and no pressure is applied to the blanket.

The present invention is particularly advantageous for printing webs, and the printing press preferably is a lithographic web printing press.

Blanket cylinder as defined herein may include the combination of a shim and blanket cylinder body and blanket as defined herein may include the combination of a blanket body and a shim.

List of Drawing Numbers

5 image cylinder
5A-D image areas
10 blanket cylinder
11 blanket cylinder convex surface
20 blanket
22 carrier sleeve layer
23 carrier sleeve outer surface
24 compressible layer
25 inextensible layer
26 print layer
27 print surface
34 compressible layer
36 print layer
100 paper
110 blanket cylinder
121 sleeve layer inner surface
122 carrier sleeve layer
123 sleeve layer outer surface
124 compressible layer
126 print layer
134 compressible layer
136 print layer
144 compressible layer
146 print layer
150 shim
156 print layer
166 print layer
176 print layer
186 print layer
210 blanket cylinder

What is claimed is:

1. A printing blanket comprising:

a carrier sleeve layer having uniform thickness and being rigid to maintain a tubular shape and flexible to permit placement on the blanket cylinder if the blanket cylinder has an outer axially convex surface or shim, the carrier sleeve layer configured to form at least one axially convex surface when the blanket is disposed on the blanket cylinder without pressure; and a print layer disposed over the carrier sleeve layer;

wherein an outer surface of the print layer is flat when the blanket is disposed on the blanket cylinder without pressure.

2. A printing blanket comprising:

a carrier sleeve layer having uniform thickness and being rigid to maintain a tubular shape and flexible to permit placement on the blanket cylinder if the blanket cylinder has an outer axially convex surface or shim, the carrier sleeve layer configured to form at least one axially convex surface when the blanket is disposed on the blanket cylinder without pressure; and a print layer disposed over the carrier sleeve layer;

wherein an outer surface of the print layer is concave when the blanket is disposed on the blanket cylinder without pressure.

* * * * *